United States Patent [19]

Metivier

[11] Patent Number: 4,893,130

[45] Date of Patent: Jan. 9, 1990

[54] ADHESIVE MOUNT MOBILE TELEPHONE ANTENNA

[75] Inventor: Donald E. Metivier, Denton, Tex.

[73] Assignee: Decibel Products, Inc., Dallas, Tex.

[21] Appl. No.: 326,276

[22] Filed: Mar. 21, 1989

[51] Int. Cl.[4] ..... H01A 1/32

[52] U.S. Cl. ..... 343/715; 343/713

[58] Field of Search ..... 343/713, 715

[56] References Cited

U.S. PATENT DOCUMENTS 4,238,799 12/1980 Parfitt ..... 343/715

4,779,098 10/1988 Blaese ..... 343/715

OTHER PUBLICATIONS

Mounting Instructions for Window Mount Antenna, The Antenna Specialists Group, 30500 Bruce Ind. Pkwy., Cleveland, Ohio, 4–1985.

*Primary Examiner*—Rolf Hille

*Assistant Examiner*—Doris J. Johnson

*Attorney, Agent, or Firm*—Richards, Medlock & Andrews

[57] ABSTRACT

An improved adhesively mounted antenna assembly (10) is provided for mounting on a vehicular window glass for a mobile telephone installation. The antenna assembly (10) includes a base (20) which is secured to the window glass by a double back adhesive tape (36). The base has a plastically deformable neck to allow the antenna to be properly oriented. A facia ring (22) is mounted to the window glass with double back adhesive tape (40) with the ring concentric with the base (20). A sealant (50) fills voids between the base, facia ring and window glass to isolate the double back adhesive tape (36) holding the base (20) to the window glass to provide more reliable and long lasting antenna installation.

14 Claims, 1 Drawing Sheet

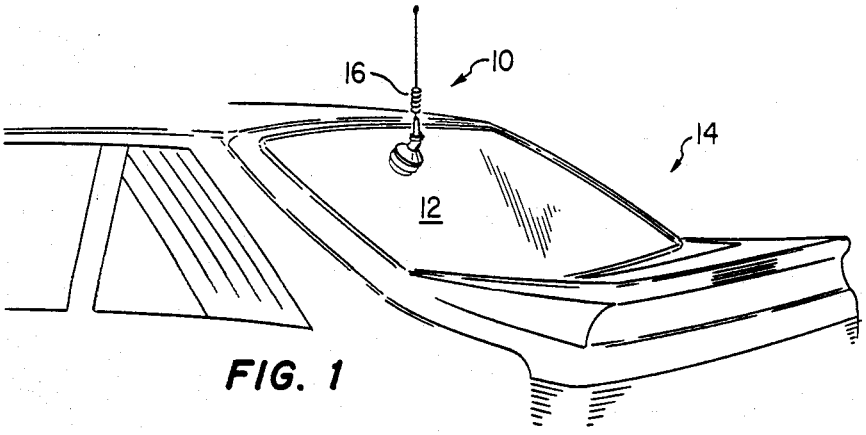
FIG. 1
FIG. 2
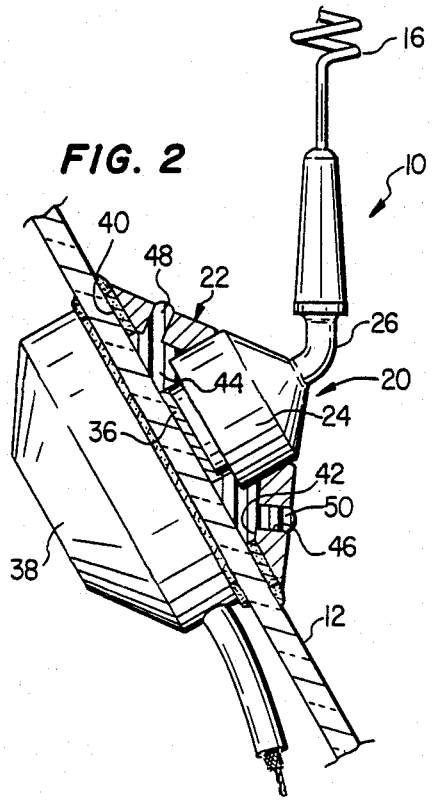
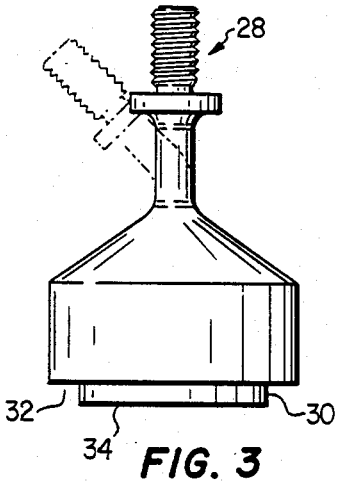
FIG. 3

ADHESIVE MOUNT MOBILE TELEPHONE ANTENNA

TECHNICAL FIELD

This invention relates generally to the mounting of an antenna, and specifically to the mounting of a mobile telephone antenna on a vehicle window glass.

BACKGROUND OF THE INVENTION

The use of mobile telephones has blossomed in the last several years as the cost of the telephones decreases, the service areas expand and the public gains a greater understanding of the versatility of the mobile telephone. This rate of growth would seem only to increase in the future as it becomes more and more accepted.

The majority of mobile telephones are permanently installed in the automobile. While the majority of components for the telephone are mounted within the automobile, the best reception and range is experienced when the telephone employs an antenna mounted external of the shell of the automobile itself. Even self-contained mobile telephones which have their own attached antenna often provide for connection to an exterior antenna for enhanced performance.

Clearly, some electrical coupling between the telephone and antenna must be used. In older designs, a flexible cable would extend from the telephone to the exterior mounted antenna. The two traditional techniques for this installation were to simply pass the cable through a partly open window, or cut an appropriately sized hole in a window or the automobile body for passage of the antenna cable. An example of a hard wired antenna is shown in U.S. Pat. No. 4,293,860, issued Oct. 6, 1981 to Iwata. The first technique provides an enhanced risk of theft or vandalism because of the partly open window. The latter increases the installation cost because of the necessity of drilling a hole and also presents the problem of filling the hole should the antenna cable be removed.

A technique has been developed for electrically coupling a telephone mounted within an automobile to an externally mounted radiator through the window of an automobile without hard wiring. One example of this technique is illustrated in U.S. Pat. No. 4,089,817 issued May 16, 1978 to Kirkendall. The antenna is comprised of components which are internal and external to the glass. Other examples are shown in U.S. Pat. No. 4,266,227 issued May 5, 1981 to Blaese and U.S. Pat. No. 4,474,353 issued Oct. 2, 1984 to Martino et. al. The completely electrical coupling does not require the physical existence of an antenna cable passing through the body or window of the automobile. While this technique has proven satisfactory, it is critical to mount the exterior radiator in a precise position relative to an element mounted on the inside of the window to provide the desired electrical coupling.

In the past, the exterior radiator has been mounted to the glass by an adhesive. However, the effects of weather and moisture have been found to degrade the adhesive with time, giving rise to the risk of moisture effects or the radiator becoming sufficiently detached from the window to interrupt the electrical coupling, or even presenting the problem of the radiator falling off the glass.

Therefore, a need exists to provide a better fastening technique for a mobile telephone exterior component of the antenna. Further, the performance of the typical glass mounted mobile telephone antenna is optimized when the elongate axis of the external radiator is vertical. Since the glass on which the radiator is mounted can vary in orientation at any angle relative to vertical, the exterior component is usually provided with a mechanism to adjust the angle of the radiator at installation.

SUMMARY OF THE INVENTION

In accordance with one aspect of the present invention, an adhesively mounted antenna is provided for mounting on a glass surface. The antenna includes a first member defining a first face. A first adhesive element is used to secure the first face of the first member to the surface. An annular facia ring concentric with the first member defines a ring face. A second adhesive element secures the ring face of the facia ring to the surface. A sealant is provided between the first member, facia ring and surface to protect the first adhesive element from damage.

In accordance with another aspect of the present invention, the first member has a neck portion that is plastically deformable to orient the radiator when mounting on glass. In accordance with another aspect, the first member includes a cylindrical base defining the first face and an antenna.

In accordance with other aspects of the present invention, the first member can be made of copper or aluminum or alloys thereof. The facia ring can be made of a polymer such as ABS or PET/PC plastic. The sealant can be a silicone based room temperature vulcanizing adhesive sealant.

BRIEF DESCRIPTION OF THE DRAWINGS

For a more complete understanding of the present invention and for further advantages thereof, reference is now made to the following Detailed Description taken in conjunction with the accompanying drawings, in which:

FIG. 1 is a perspective view of an antenna assembly forming a first embodiment of the invention installed on vehicle window glass;

FIG. 2 is a partial cross sectional view of the antenna assembly mounted on the window glass; and FIG. 3 is a side view of the base of the antenna assembly.

DETAILED DESCRIPTION

With reference now to the accompanying Drawings, wherein like reference numerals designate like or corresponding parts throughout the several views, FIG. 1 illustrates an antenna assembly 10 mounted on the exterior of a window glass 12 of the automobile 14. The antenna assembly 10 includes a radiator 16 which is preferably oriented with its elongate axis vertical for maximum performance. The antenna assembly 10 includes an external portion which includes the radiator 16, and an internal portion which is connected to the internal electronics, typically a mobile telephone. The interior and exterior portions are electrically coupled by a capacitive coupling as disclosed in U.S. Pat. No. 4,089,817, issued May 16, 1978 to Kirkendall, which patent is hereby incorporated in its entirety by reference herein.

The external portion of the antenna assembly 10 FIGS. 2 and 3 includes a base 20, a facia ring 22 and the radiator 16. The base 20 includes a cylindrical portion 24, a neck portion 26 and a threaded portion 28 to mount the radiator 16. Cylindrical portion 24 has an extension 30 which is of reduced diameter to define an annular notch 32. The neck portion 26 is reduced to allow the neck portion to be plastically deformed to orient the radiator 16. The radiator 16 with adapter is threaded on to the threaded portion 28 of the neck portion 26.

The extension 30 has a flat first face 34. A double back adhesive tape 36 is secured on one side to the first face 34, and on the other side to the exterior surface of the window glass 12. An interior coupler 38, forming part of the interior portion of the antenna assembly, is similarly mounted to the interior surface of the window glass by a double back adhesive tape to electrically couple the external components of the antenna to the internal electronic mechanism. As described to this point, the interior coupler will more than likely remain secured to the window glass during the useful life of the antenna assembly. However, the existence only of a base mounted to the exterior surface of the window glass by a double back tape would be subject to external environmental effects, such as rain, moisture, mist and the like, which would tend to rapidly degrade the adhesive quality of a double back tape, quickly permitting moisture to enter the gap and degrade the electrical coupling between the components, or even permitting the radiator to completely fall off the window glass.

To remedy this problem, the facia ring 22, which has a central opening somewhat larger in diameter than the diameter of the cylindrical portion 24, is designed to slip over the base and be secured to the exterior surface of the window glass by double back adhesive tape 40. The facia ring 22 is in the form of a hollow semi-conical shape which defines an annular interior 42 which cooperates with the notch 32 to define an annular cavity 44. An inlet port 46 is formed through the facia ring 22 and opens into the cavity 44 from the exterior of the ring. An outlet port 48 is similarly formed through the ring on the side of the ring opposite inlet port 46. After both the base and facia ring have been secured to the exterior surface of the window glass by double back tapes 36 and 40, a hardenable sealant 50 is pushed through inlet port 46 to fill the cavity 44. When the sealant begins to extrude out port 48, it can be reliably assumed that the cavity is completely full. After the sealant has hardened, the double back tape 40 and sealant 50 both provide protection from environmental factors to the double back adhesive 36 holding the base 20 to the window glass. Since the facia ring provides no part of the electrical coupling between the mobile telephone and antenna, a degradation of the double back adhesive tape 40 is of little concern to the performance of the telephone. Even if the tape 40 fails, and the ring 22 is detached from the window glass, the sealant 50 will still protect the tape 36. It would then even be possible to remove the sealant, reinstall a facia ring with a renewed tape 40 and provide new sealant to essentially bring the antenna assembly to a new condition. A suitable adhesive can be substituted for either tape 36 or tape 40, or both, if desired.

The base 20 is preferably formed of a copper alloy. An alloy made in accordance with the specifications of ASTM 124 would be suitable, as would a copper alloy No. 655 applicable to ASTM Specification B98. The cylindrical portion 24 in one embodiment has an exterior diameter of one inch, while the extension 30 has an exterior diameter of 0.75 inches. The height of the cylindrical portion 24 is 0.390 inches, while the height of the cylindrical portion 24 and extension 30 is 0.49 inches. The neck portion tapers from the cylindrical portion 24 at an angle of 55° in a conical section, but curves to a neck of 0.150 inch diameter where the plastic deformation takes place to orient the radiator.

The facia ring is preferably made of a polymer plastic such as acrylonitrile butadiene styrene (ABS) or a polycarbonate and polyethylene tetrephythalate (PET/PC) blend. A suitable ABS plastic is manufactured by the General Electric Company. A suitable PET/PC plastic is made by Mobay. The preferred sealant is a silicone based room temperature vulcanizing (RTV) adhesive. General Electric Company makes an RTV sealant suitable for this function which is identified as item RTV-103.

Although the present invention has been described with respect to a single embodiment thereof, various changes and modifications may be suggested to one skilled in the art, and it is intended that the present invention encompass such changes and modifications as fall within the scope of the appended claims.

I claim:

1. An antenna mount for adhesive attachment to the surface of a non-conducting body, comprising:
   - a first electrically conductive member defining a first face and having a plastically deformable neck for coupling to said antenna wherein the orientation said antenna with respect to said surface can be set by plastically deforming said neck;
   - a first adhesive element for securing said first face to said surface;
   - a facia ring surrounding said first member and defining a ring face;
   - a second adhesive element for securing said ring face to said surface, and
   - a sealant between and bonded to said first member, said ring and said surface for protecting said first adhesive element from damage.

2. The antenna mount of claim 1 wherein the first member has a cylindrical base defining the first face, and a plastically deformable neck to mount an antenna which neck can be plastically deformed to orient the radiator before or after mounting of the antenna assembly on the surface.

3. The antenna mount of claim 1 wherein the first member is formed of an alloy of copper.

4. The antenna mount of claim 1 wherein the facia ring is formed of a polymer plastic.

5. The antenna mount of claim 1 wherein the sealant is a silicone based room temperature vulcanizing adhesive.

6. The antenna mount of claim 1 wherein the first member includes a cylindrical portion and an extension, the first face being formed on the extension and an annular notch formed between the cylindrical portion and extension, said facia ring defining an interior, the interior of the facia ring and notch of the first member forming an annular cavity receiving the sealant.

7. The antenna mount of claim 1 wherein the facia ring has at least one port formed therethrough for entry of the sealant between the first member, facia ring and surface.

8. The antenna mount of claim 7 wherein the facia ring has a second port to vent the sealant received between the first member, facia ring and surface.

9. The antenna mount of claim 1 wherein the first and second adhesive elements are double back adhesive tape.

10. The antenna mount of claim 1 wherein the first and second adhesive elements are each a layer of adhesive.

11. The antenna mount of claim 1 wherein the neck has a threaded portion for receiving the antenna.

12. A method for installing an antenna mount for adhesive attachment to the surface of a non-conducting body, comprising:

securing a first member defining a first face to the surface with a first adhesive element between the surface and the first face;

positioning an annular facia ring concentric with the first member, the facia ring defining a ring face, and securing the facia ring to the surface with a second adhesive element between the ring face and the surface;

filling voids between the facia ring, first member and surface with a sealant to protect the first adhesive element from damage; and plastically deforming a neck portion of the first member to orient an antenna coupled to the first member to a selected orientation with respect to the surface;

13. The method of claim 11 further comprising the step of filling the voids with sealant through a port formed in the facia ring; and 14. The method of claim 11 further comprising the step of screwing on an antenna to a threaded portion of the neck portion of the first member.

* * * * *